US006957638B2

(12) United States Patent
Scharp

(10) Patent No.: US 6,957,638 B2
(45) Date of Patent: Oct. 25, 2005

(54) PISTON FOR AN INTERNAL COMBUSTION ENGINE

(75) Inventor: Rainer Scharp, Vaihingen (DE)

(73) Assignee: Mahle GmbH, Stuttgart (DE)

( * ) Notice: Subject to any disclaimer, the term of this patent is extended or adjusted under 35 U.S.C. 154(b) by 115 days.

(21) Appl. No.: 10/748,904

(22) Filed: Dec. 30, 2003

(65) Prior Publication Data

US 2004/0250779 A1 Dec. 16, 2004

(30) Foreign Application Priority Data

Jun. 12, 2003 (DE) ..... 103 26 456

(51) Int. Cl.[7] ..... F02F 7/00
(52) U.S. Cl. ..... 123/193.6; 123/193.1; 123/41.35
(58) Field of Search ..... 123/193.1, 193.6, 123/193.2, 193.4, 41.35

(56) References Cited

U.S. PATENT DOCUMENTS 5,261,363 A * 11/1993 Kemnitz ..... 123/193.6
6,701,875 B2 * 3/2004 Weng et al. ..... 123/41.35

FOREIGN PATENT DOCUMENTS

DE 33 38 419 10/1983

* cited by examiner

*Primary Examiner*—Bibhu Mohanty
(74) *Attorney, Agent, or Firm*—Collard & Roe, P.C.

(57) ABSTRACT

A one-piece piston for an internal combustion engine, having a ring-shaped cooling channel arranged in the outer region of the piston head, is proposed, which is closed off by a ring-shaped cooling channel cover structured towards the side of the pin bosses as a support element. This cooling channel cover comprises at least two arc-shaped cover elements the outer edge of which supports the pin-boss-side face of the ring wall.

4 Claims, 4 Drawing Sheets

PISTON FOR AN INTERNAL COMBUSTION ENGINE

CROSS REFERENCE TO RELATED APPLICATIONS

Applicant claims priority under 35 U.S.C. §119 of German Application Serial No. 103 26 456.6 filed on Jun. 12, 2003.

BACKGROUND

The invention relates to a piston for an internal combustion engine.

A multi-part piston for a reciprocating piston internal combustion engine is known from the German reference DE 33 38 419, which has a piston head having a ring-shaped cooling channel arranged in its outer region. With this design, the radially outer delimitation of the cooling channel is formed by a ring wall molded onto the outer region of the piston head and serves as a carrier for the piston rings. Towards the side of the pin boss, the cooling channel is closed off by a ring-shaped cooling channel cover structured as a support element. The inside edge of the support element is held by a ring nut, which is screwed onto a ring-shaped projection, molded onto the piston head, and the outer edge of the support element supports the ring wall by way of the pin-boss-side face of the ring wall, to prevent the outer region of the piston head from being deformed during the work cycle of the piston.

A disadvantage of this design is that within the scope of the very complicated assembly of the known piston, the cooling channel cover must first be pushed onto the bottom of the upper part of the piston, which faces the piston head, before the ring nut can be screwed onto the projection and thereby the cooling channel cover can be screwed on tightly. Only then can the remaining assembly of the piston take place, during which the piston shaft is pushed onto the bottom of the upper part of the piston and attached to it by means of a piston pin sleeve.

Proceeding from this, the invention is based on the task of creating a one-piece piston having a cooling channel, wherein the channel can quickly and easily be closed off with a cover, which improves the rigidity of the piston.

SUMMARY OF THE INVENTION

This task is accomplished in that pin bosses are molded onto the piston head, by way of pin boss supports, the faces of which bosses are arranged set back relative to the radially outer edge of the piston head, wherein the pin bosses are connected by way of skirt elements that are molded onto the piston head by way of skirt connections that have concave recesses in the region between the skirt elements and the piston head. In addition, the cooling channel cover comprises at least two arc-shaped cover elements, the inner edge of which is supported in a recess worked partly into the pin boss support and partly into the skirt connection, and the outer edge of which supports the ring wall by way of the pin-boss-side face of this ring wall.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
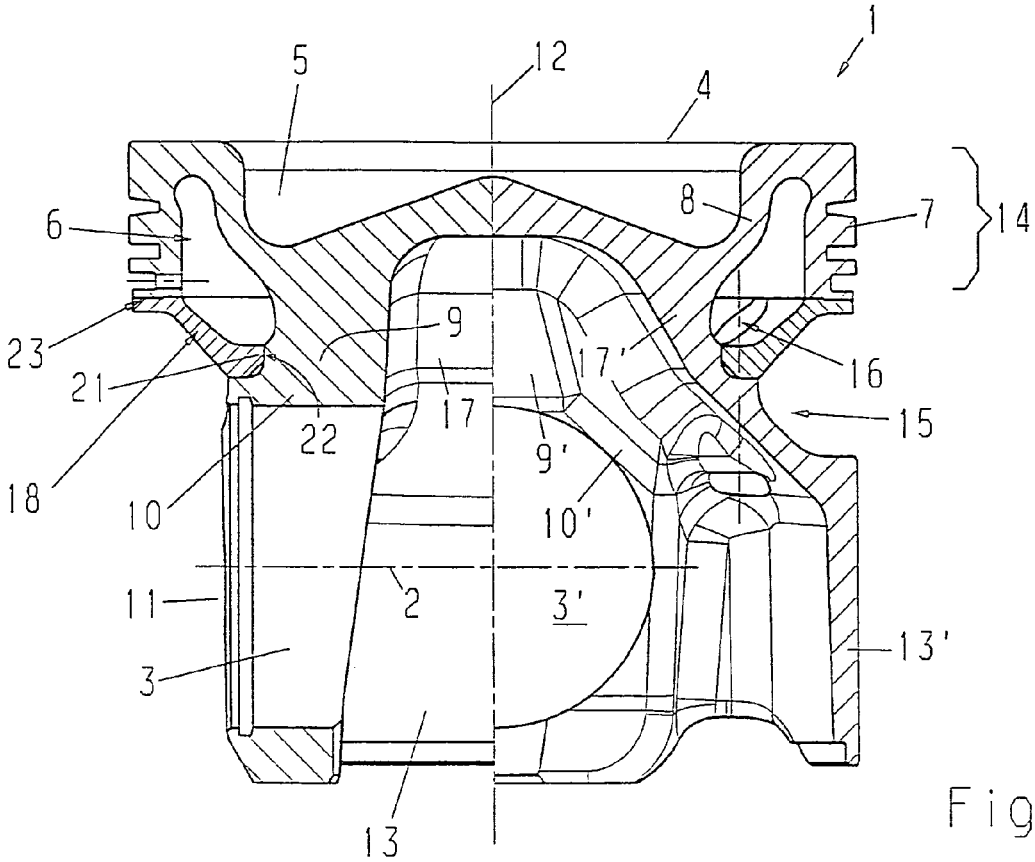
FIG. 1 is a side cross-sectional representation of a piston for an internal combustion engine, having a cooling channel cover shown in a cross-sectional diagram comprising two halves, which shows two longitudinal sections of the piston, offset by 90°.

Referring to the drawings, FIG. 1 shows a piston 1 for an internal combustion engine, structured in one piece, in a cross-sectional diagram that comprises two halves, the left half showing a cross-section of the piston 1 along a longitudinal axis 2 of a pin bore 3, and the right half showing a cross-section of the piston 1 offset from the left half by 90°. Piston 1 is made of steel, and has a combustion bowl 5 in the region of piston head 4. A ring-shaped cooling channel 6 is arranged in the radially outer region of the piston head 4. The radially outer delimitation of this channel is formed by a ring wall 7 molded onto the piston head 4, and the radially inner delimitation of this channel is formed partly by a ring rib 8, partly by a pin boss support 9, 9', and partly by a skirt connection 17, 17'. With this design, ring wall 7 serves as a piston ring carrier.

A pin boss 10, 10', having a pin bore, 3, 3', in each instance, is molded onto piston head 4, in each instance, by way of the pin boss supports 9, 9'. Faces 11 of pin bosses 10, 10' are arranged set back relative to ring wall 7, in the direction of the longitudinal piston axis 12. Pin bosses 10, 10' are connected with one another by way of skirt elements 13, 13', which are connected with piston head 4 by way of a skirt connection 17, 17', in each instance. Piston head 1 has recesses 15 between skirt elements 13, 13' and the piston-head-side region 14 of piston 1.

Figure 3:
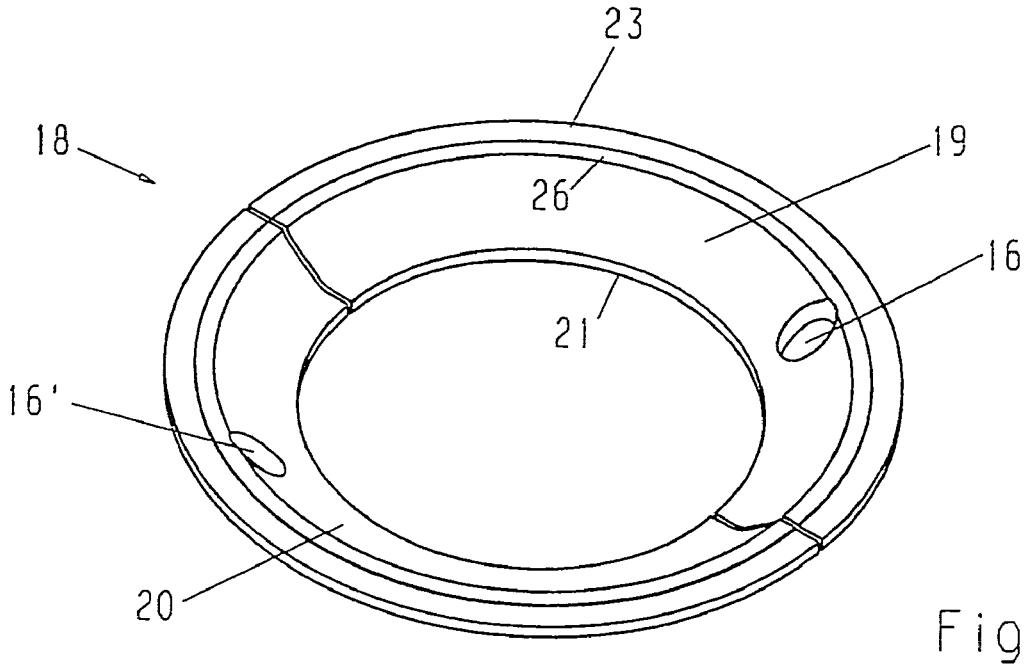
FIG. 3 is a cooling channel cover that comprises two semi-circular halves.

Adjacent to pin bosses 10, 10', cooling channel 6 is covered by a cooling channel cover 18, which is structured as a solid support element and comprises two semi-circular cover elements 19 and 20, (See FIG. 3). Cooling channel cover 18, which has an opening 16 (see FIG. 1) to allow cooling oil to flow in, and an opening 16', shown only in FIG. 3, for the oil to flow out, is structured conically, similar to the edge of a plate, and rests with its inner edge 21 in a circumferential recess 22, which is worked partly into pin boss supports 9, 9' and partly into skirt connections 17, 17'. Outer edge 23 of cooling channel cover 18 forms a contact surface for the pin-boss-side face of ring wall 7, so that cooling channel cover 18 prevents load-related deformations of the outside region of piston head 4 and of ring wall 7, to a great extent, in its capacity as a support element, particularly during the work cycle of piston 1.

Figure 2:
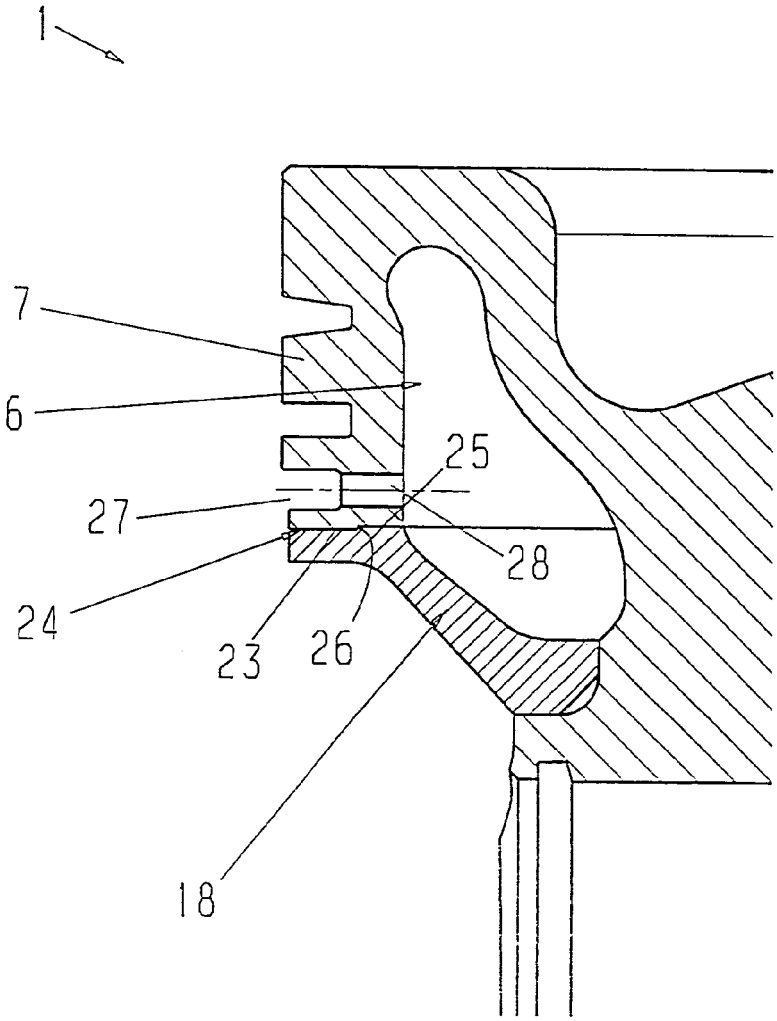
FIG. 2 is a representation of the cooling channel and the cooling channel cover on a larger scale, after its final assembly.

The enlarged cross-sectional diagram according to FIG. 2 shows that piston-pin-side face 24 of ring wall 7 has a step-shaped undercut 25 that corresponds, in its shape, to a recess 26, also step-shaped, made in outer wall 23 of cooling channel cover 18, so that after final assembly of piston 1, undercut 25 and recess 26 engage into one another and contribute to the prevention of load-related deformations of the outer region of piston head 4. Furthermore, it is evident in FIG. 2 that oil drain holes 28 are arranged between groove 27 for the oil ring (not shown in the figure) and cooling channel 6.

Cooling channel cover 18 shown in FIG. 3 comprises of two semi-circular cover elements 19 and 20. However, it can also be structured in three or more parts. The step-shaped recess 26 worked into outer edge 23 and opening 16 for oil to flow in and opening 16' for oil to flow out can be seen.

Figure 4:
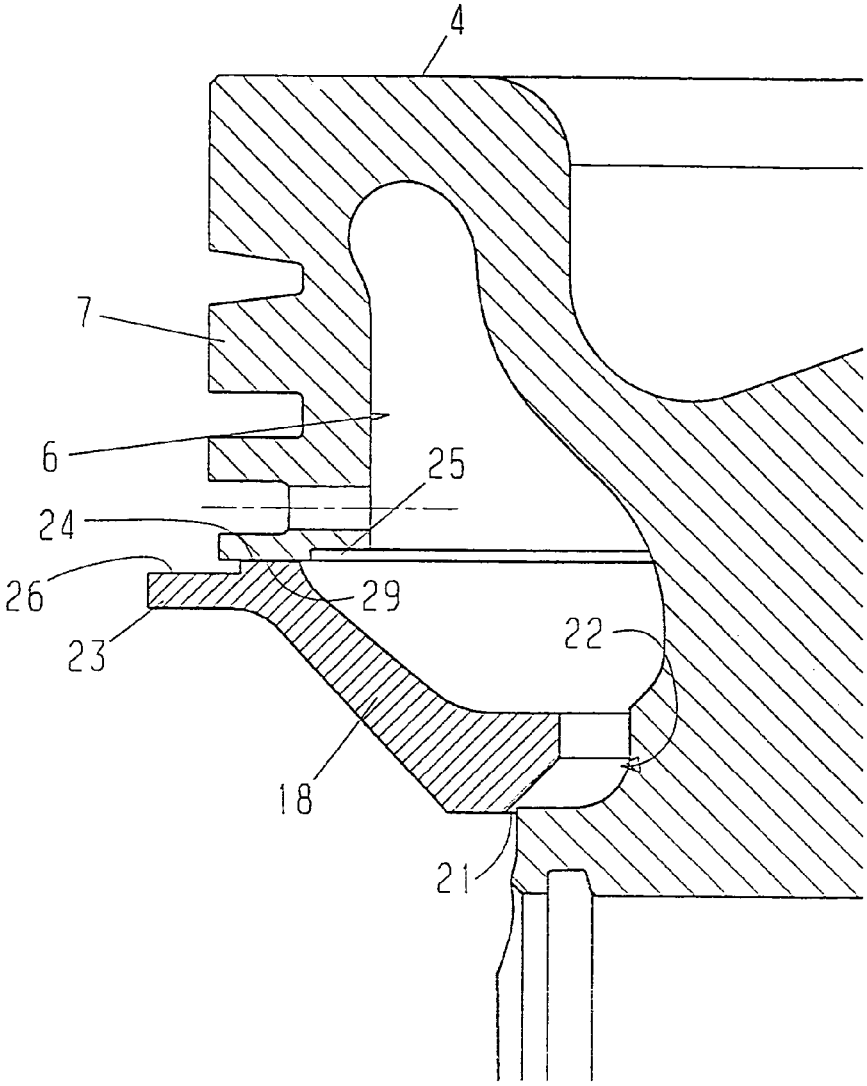
FIG. 4 is a side cross-sectional diagram, in a larger scale, of the cooling channel, with an arrangement of the cooling channel cover that results within the scope of the assembly of the piston.

The method of assembly of cooling channel cover 18 shall be illustrated using FIG. 4. The cover is first brought into contact, with its radially inner edge 21, against an edge of recess 22 in piston head 4 and, with its radially outer edge 23, against face 24 of ring wall 7, as shown in FIG. 4. Subsequently, inner edge 21 is pressed axially in the direction of piston head 4, whereby cooling channel cover 18 is preloaded and can be radially pushed inward, so that it comes to rest in recess 22 with its inner edge 21. In this position, cooling channel cover 18 is fixed in place wherein it snaps from step 29 formed by recess 26 into undercut 25 of face 24. Cooling channel cover 18 is structured so that after the final assembly, it maintains a slight deformation and thereby a permanent preload securing cooling channel 18 to piston head 4.

Accordingly, while at least one embodiment of the present invention have been shown and described, it is to be understood that many changes and modifications may be made thereunto without departing from the spirit and scope of the invention as defined in the appended claims.

REFERENCE SYMBOL LIST

1 piston
2 longitudinal axis
3, 3' Pin bore
4 piston head
5 combustion bowl
6 cooling channel
7 ring wall
8 ring rib
9, 9' pin boss support
10, 10' pin boss
11 face, or opening
12 longitudinal piston axis
13, 13' skirt element
14 piston-head-side region
15 recess
16, 16' opening
17, 17' skirt connection
18 cooling channel cover; or annular ring
19 cover element
20 cover element
21 inner edge of the cooling channel cover 18
22 recess
23 outer edge of the cooling channel cover 18
24 face of the ring wall 7
25 undercut of ring wall 7
26 recess of cooling channel cover
27 groove
28 oil drain hole
29 step; or flange

What is claimed is:

1. A one piece piston for an internal combustion engine comprising:

a) a piston head formed along a longitudinal piston axis;

b) at least two pin boss supports molded in said piston head;

c) at least two pin bosses formed from said at least two pin boss supports wherein said at least two pin boss supports and a set of faces for said at least two pin bosses are set back relative to a radially outer edge of said piston head, in a direction of said longitudinal piston axis;

d) at least two skirt elements coupling said at least two pin bosses for connecting said at least two pin bosses together;

e) at least one skirt connection for connecting said skirt elements to said piston head; wherein said at least one skirt connection form a concave recess between said skirt elements and said piston head;

f) at least one ring wall having at least one pin-boss side face and coupled to said piston head, forming at least one ring shaped cooling channel extending around an outer region of said piston head, wherein a radially outer region is deliminated by said ring wall and a radially inner region is formed at least partially by said at least two pin boss supports and at least partly by said at least one skirt connection; and g) at least one cooling channel cover extending between said at least one skirt connection and said at least one ring wall, wherein said at least one cooling channel cover comprises at least two arc shaped cover elements, which close off said cooling channel towards a side of said at least two pin bosses, wherein an inner edge of said cooling channel cover, is supported in a recess which is worked at least partly into said at least two pin boss supports and at least partly into at least one skirt connection, and wherein an outer edge of said at least one cooling channel cover supports said at least one ring wall.

2. The piston as in claim 1, wherein said at least two cooling channel cover elements are formed semi-circular.

3. The piston as in claim 1, wherein said cooling channel cover is structured so that it can be clamped between said ring wall face and said recess in said at least two pin boss supports.

4. The piston as in claim 3, wherein said at least one ring wall face has a step-shaped undercut and wherein said at least one cooling channel cover has a step-shaped recess formed so that when said cooling channel cover is assembled, a step is formed by said step-shaped recess which snaps into said step-shaped undercut of said ring wall face.

* * * * *